US007845495B2

(12) United States Patent
Baker et al.

(10) Patent No.: US 7,845,495 B2
(45) Date of Patent: Dec. 7, 2010

(54) PRODUCT PACKAGING SYSTEM WITH LOCK RELEASE

(75) Inventors: Michael A. Baker, Kenosha, WI (US); Richard Schmerling, Trevor, WI (US); Leonard E. Ekdahl, Antioch, IL (US); Dawn M. Kempf, Fox Lake, IL (US); Gregory L. Davis, Winthrop Harbor, IL (US); Kregg Albrecht, Pleasant Prairie, WI (US)

(73) Assignee: NOSCO, Inc., Gurnee, IL (US)

( * ) Notice: Subject to any disclaimer, the term of this patent is extended or adjusted under 35 U.S.C. 154(b) by 1035 days.

(21) Appl. No.: 11/504,305

(22) Filed: Aug. 14, 2006

(65) Prior Publication Data

US 2007/0045147 A2 Mar. 1, 2007
US 2007/0199857 A9 Aug. 30, 2007

Related U.S. Application Data

(60) Provisional application No. 60/736,732, filed on Nov. 15, 2005.

(51) Int. Cl.
*B65D 83/04* (2006.01)

(52) U.S. Cl. ..... 206/531; 206/1.5; 206/532; 206/534.1

(58) Field of Classification Search ..... 206/531, 206/538, 532, 536, 534.1, 534.2, 525, 526, 206/1.5, 467, 468, 308.2, 831
See application file for complete search history.

(56) References Cited

U.S. PATENT DOCUMENTS 3,129,817 A 4/1964 Rohdin
3,610,410 A 10/1971 Seeley
3,809,220 A 5/1974 Arcudi
3,809,221 A 5/1974 Compere
3,811,564 A 5/1974 Braber
3,835,995 A 9/1974 Haines
3,872,970 A 3/1975 Edison
3,899,080 A 8/1975 Brunda
3,905,479 A 9/1975 Gerner et al.
3,912,081 A 10/1975 Haines et al.
3,912,082 A 10/1975 Gerner et al.
3,921,805 A 11/1975 Compere
3,924,746 A 12/1975 Haines
3,924,747 A 12/1975 Gerner
3,941,248 A 3/1976 Moser et al.

(Continued)

FOREIGN PATENT DOCUMENTS

EP 0 031 547 A1 7/1981

(Continued)

*Primary Examiner*—Mickey Yu
*Assistant Examiner*—Sharon M Prange
(74) *Attorney, Agent, or Firm*—Schiff Hardin LLP

(57) ABSTRACT

A child resistant, senior friendly packaging system is designed to securely hold multiple unit dose products and formed out of natural fiber or synthetic materials, or any combination thereof. The packaging system comprises a movable insert that can locked in an inaccessible position and comprises a physically detachable unlocking mechanism that can engage the locking mechanism of the movable insert in order to unlock the movable insert permitting movement into an accessible position. The unlocking mechanism can be in the form of an access card that is a part of the system or is user supplied.

9 Claims, 14 Drawing Sheets

U.S. PATENT DOCUMENTS 4,011,949 A 3/1977 Braber et al.
4,120,400 A 10/1978 Kotyuk
4,125,190 A 11/1978 Davie, Jr. et al.
4,192,422 A 3/1980 Kotyuk
4,231,477 A 11/1980 De Felice
4,437,566 A * 3/1984 Szahler ..... 206/1.5
4,485,915 A 12/1984 Berghahn
4,506,789 A 3/1985 Dlugosz
4,535,890 A 8/1985 Artusi
4,589,549 A * 5/1986 Hehn ..... 206/387.11
5,046,618 A 9/1991 Wood
5,088,599 A 2/1992 Mahler
5,172,812 A 12/1992 Wharton et al.
5,310,060 A 5/1994 Bitner et al.
5,529,188 A 6/1996 Coggswell
5,680,782 A * 10/1997 Komatsu et al. ..... 70/57.1
6,032,795 A 3/2000 Ehrlund et al.
6,047,829 A 4/2000 Johnstone et al.
6,230,893 B1 5/2001 Karow
6,375,956 B1 4/2002 Hermelin et al.
6,412,636 B1 7/2002 Jones et al.
6,491,211 B1 * 12/2002 Evans et al. ..... 229/102
6,523,691 B2 2/2003 Raj et al.
6,641,031 B2 11/2003 Evans et al.
6,752,272 B2 * 6/2004 Jones et al. ..... 206/534
6,874,636 B2 4/2005 Paliotta et al.
6,926,161 B2 8/2005 Miceli et al.
2001/0017273 A1 8/2001 Raj et al.
2002/0185404 A1 12/2002 Donegan
2003/0064381 A1 4/2003 Feder et al.
2004/0045858 A1 3/2004 Harrold
2004/0050748 A1 3/2004 Ehrlund
2004/0099565 A1 5/2004 Dehlin et al.
2004/0262189 A1 * 12/2004 Fraser et al. ..... 206/536

FOREIGN PATENT DOCUMENTS

EP 1 002 744 A1 5/2000

* cited by examiner

PRODUCT PACKAGING SYSTEM WITH LOCK RELEASE

CROSS REFERENCE TO RELATED APPLICATIONS

The present application claims the benefit of U.S. Provisional Application No. 60/736,732, filed Nov. 15, 2005, herein incorporated by reference.

BACKGROUND

The invention is directed to child resistant, senior friendly packaging designed to securely hold multiple unit dose products and formed out of natural fiber or synthetic materials, or any combination thereof.

The field of packaging is challenged to provide the end user with packaging designed, or constructed, to hold multiple unit doses in a package that is child resistant and yet senior friendly. The criteria of child resistance requires a package be designed in a manner so that it is extremely difficult for a child (under the age of five) to gain access to any of the unit doses. The criteria of senior friendliness requires a package that is designed to have the unit doses easily accessed by a mature adult who may be arthritic or weak. Clearly, these two criteria are difficult to balance, i.e., making a package difficult for a child to open, but easy for a senior to open.

Known packages, in their most basic form, may simply rely on features such as pull tabs to cover the cell cavities holding the unit dose product. tabs to cover the cell cavities holding the unit dose product. Examples of such packages are disclosed in U.S. Pat. Nos. 3,129,817; 3,610,410; 3,809,220; 3,809,221; 3,811,564; 3,835,995; 3,872,970; 3,899,080; 3,905,479; 3,912,081; 3,912,082; 3,921,805; 3,924,746; 3,924,747; 3,941,248; 4,011,949; 4,120,400; 4,125,190; 4,192,422; 4,231,477; 4,485,915; 4,506,789; 5,046,618; 5,172,812; 5,310,060; 5,529,188; 6,047,829; 6,375,956; and 6,523,691 as well as U.S. patent publication nos. 2001/0017273; 2002/0185404; and 2003/0064381.

These references and any other reference cited herein are incorporated by reference.

Tabs designed in such a manner, which are difficult for children to remove, are normally not senior friendly; conversely, tabs that can be easily removed by mature adults are normally not child resistant. Integrated tabs of this type can be defined as "first level" resistance in paperboard packaging.

In certain instances, it maybe desirable if the package requires the individual to perform a sequence of steps, perhaps simultaneously. An illustration of this is for an individual to first read a set of specific instructions and then perform a sequence of steps simultaneously. For example, the product can be opened by holding package in the left hand, while pressing down on a lock release, and pulling out a slide card with the right hand. Typically, children under the age of five have great difficulty reading and comprehending instructions, while simultaneously attempting to perform a series of sequential steps, thereby rendering the package child resistant. Examples of this are disclosed in U.S. patent publication nos. 2004/0099565 and 2004/0045858, as well as U.S. Pat. No. 6,752,272.

However, a complete packaging system designed with the aforementioned features can be further defined as both child resistant and senior friendly. For example, Mature adults are able to read and comprehend instructions and can perform a series of sequential steps simultaneously.

Such a multi step packaging system is advantageous in that it prevents young children from accessing unit dose products, while allowing mature adults access to the individual unit doses contained therein. Additionally, this type of package can be opened and closed repeatedly, which is particularly advantageous when there are unused unit doses remaining inside the package. A package, as described, can continue to provide reassurance that the complete package maintains its child resistant and senior friendly characteristics throughout the dispensing life of the package.

Known packaging systems containing both child resistant and senior friendly features are disadvantageous, in that certain mature adults may find it difficult to gain access to the unit dose product. For example, an adult with arthritis in the joints of the hands may have difficulty in performing a series of sequential steps, such as grasping and holding the package, pressing down on a lock release, and pulling out a slide card containing unit dose product. Such packaging systems, which encumber access to the unit dose product by a mature adult, may have the very features, which are child resistant, circumvented in such a manner that the complete package no longer provides child resistance.

Therefore, it is preferable to provide an option whereby the child resistant features can be disengaged, long term. For example, some styles of child resistant bottle caps are manufactured with one end containing internal screw threads and a locking mechanism, while the opposite end contains external screw threads only. Such a system is disclosed by U.S. Pat. No. 6,926,161.

SUMMARY

It is the object of the invention to provide a complete packaging system containing multi step child resistance and senior friendly features. In addition, this packaging system may be configured to allow for long term disabling of the child resistant features. Within the scope of this new invention is a multiple lock system, a detachable and reusable access card and card slot.

This object is solved according to an embodiment of the invention by providing a lock system, designed into a single integrated or unibody package, which is released through the use of a detachable and reusable access card. The invention is to be broadly construed as any single integrated or unibody package with a lock system released by any type of reusable card. For example, a credit card, picture ID card, or drivers license. However, the preferred embodiments described below utilize a packaging system formed out of paperboard, natural fiber or synthetic materials or any combination thereof and designed to securely hold multiple unit dose products.

According to preferred embodiments of the invention, an outer folding carton, containing a detachable and reusable access card, and an internal slide tray are formed out of paperboard or synthetic paperboard material, or any combination thereof.

The access card is detached from one of a plurality of side panels and inserted into a card slot in one of a plurality of end panels.

Should the access card remain in the card slot, the multiple lock system is temporarily disabled and the package is placed into a non-child resistant, or open state. Removing the access card reactivates the multiple lock system and returns the package to the previously child resistant condition.

DESCRIPTION OF THE DRAWINGS

The invention is explained below based on drawings showing the various embodiments of the invention.

DETAILED DESCRIPTION OF THE PREFERRED EMBODIMENTS

An embodiment of the invention comprises an outer folding carton containing a detachable and reusable access card, and an internal slide tray.

Figure 1:
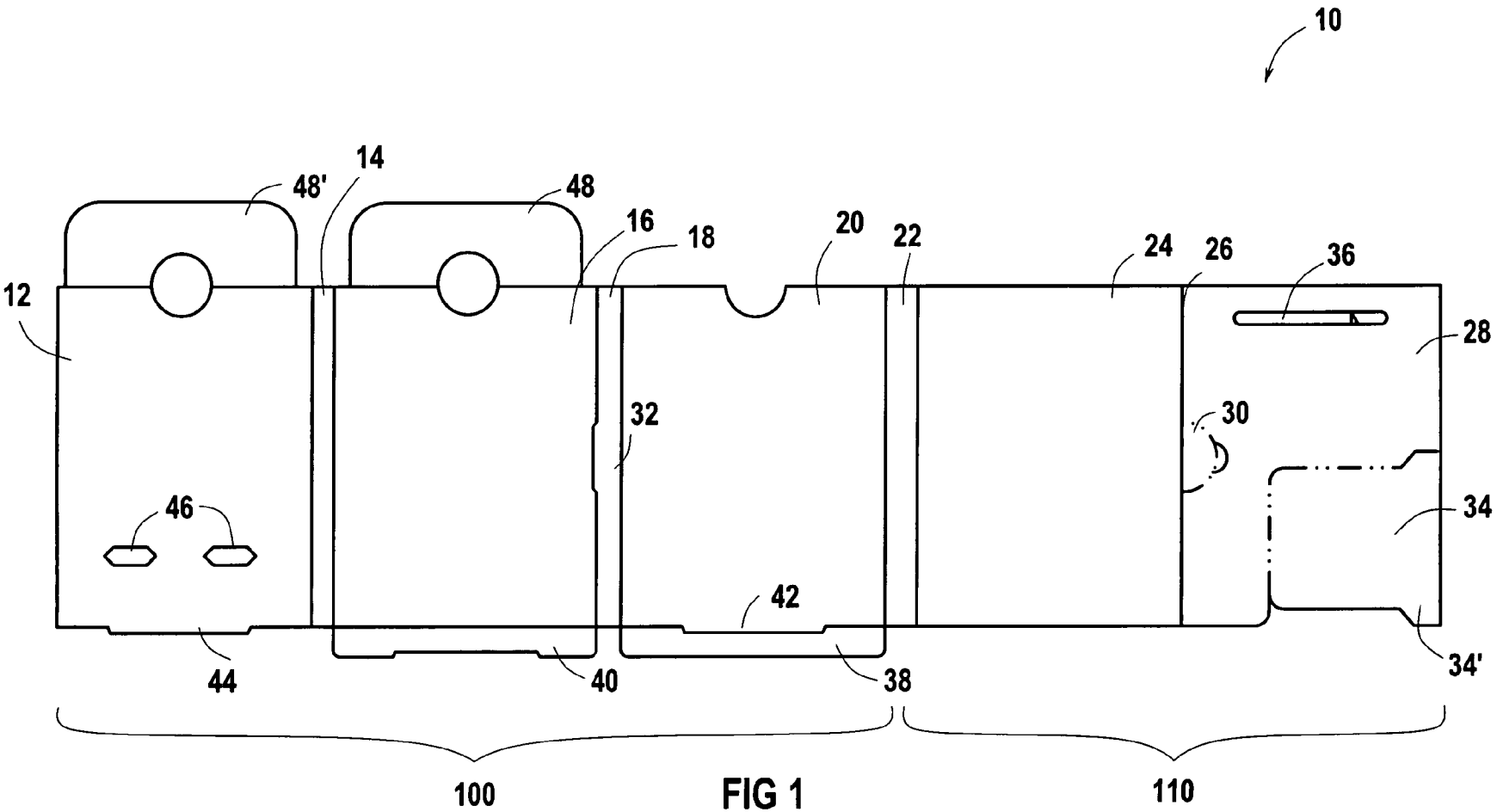
FIG. 1 is a pictorial diagram of an unassembled outer folding carton having five panels.

FIG. 1 illustrates an exemplary outer folding carton 10, comprising a plurality of panels 12, 16, 20, 24, 28 that are designed to be folded along fold portions 14, 18, 22, 26 with selected panels glued together. A first panel 12 is folded along a first fold portion 14, and then the first panel 12 along with a second panel 16 are folded along a second fold portion 18 and the first panel 12 is glued to a third panel 20 such that a gap approximately the width of the first 14 and second 18 fold portion is formed between a) the glued first 12 and third 20 panels, and b) the second panel 16. The first three panels 12, 16, 20, when assembled, comprise a first primary section 100 that will hold the internal slide tray 50.

The first panel 12 has a tab 44 that is used as a protruding guide for the access card 34 card when the carton is assembled. The lower pane extension 40 of the second panel 16 and the lower panel extension with slot 38 of the third panel 20, when assembled, extend in a direction perpendicular to the plane of the drawing page, creating depth or thickness to the carton and thereby forming a corner at which the access card slot 42 is present.

It should be noted that the description below refers to the slide tray 50 in an embodiment of the invention. However, the invention contemplates any slidable element, such as a movable tray, slide card or package.

The fourth panel 24 and the fifth panel 28 are glued together at selected portions along fold line 26 and form a second primary section 110. Thus, in its assembled condition, the outer folding carton appears as two primary sections 100, 110, each having panels glued together. The first primary section 100 comprises the first through third panels 12, 16, 20, and the second primary section 110 comprises the fourth and fifth panels 24, 28. The first three fold sections 14, 18, 22 have two fold lines so that the panels are separated from one another with a distance sufficient to accommodate the thickness of the internal slide tray 50. During manufacturing the first panel to be folded and glued will be panel 28, followed by panel extensions 48, then panels 12 and 16.

Figure 2:
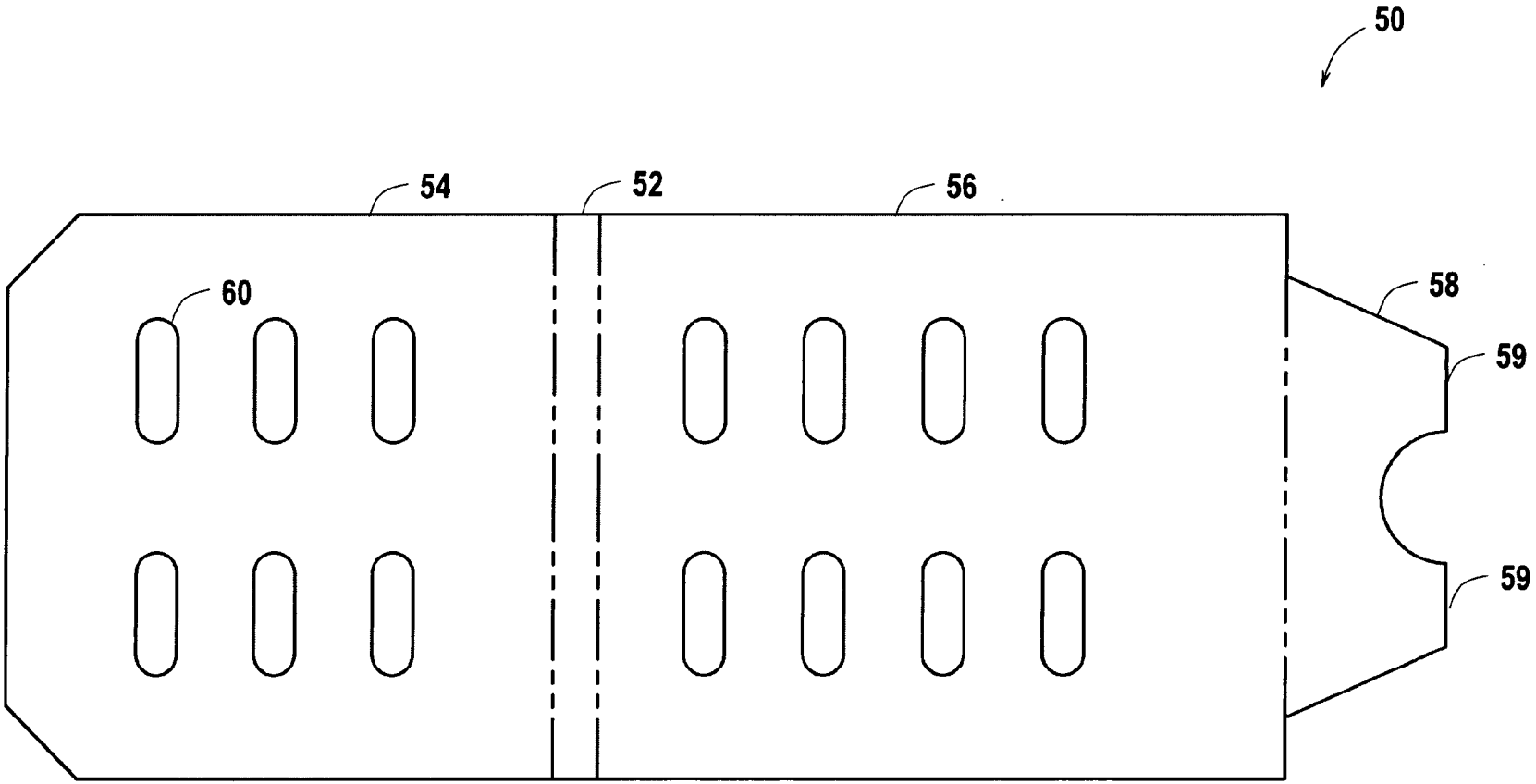
FIG. 2 is a pictorial diagram of a completely assembled internal slide tray.

The internal slide tray 50, as illustrated in FIG. 2, comprises a first panel 54 and a second panel 56 that are folded together along a fold portion 52. These panels are configured to hold, e.g., single dose units, such as a bubble pack 60', although obviously any mechanism for holding the product can be utilized. The fold portion 52 comprises two fold lines so that the panels 54, 56, when folded together, have a gap between them large enough to accommodate the product.

The internal slide tray 50 further comprises an end tab 58 that may further comprise two sub-tabs 59. This tab 58 and sub-tabs 59 are configured to interact with the outer folding carton 10 in a manner that will be explained below.

Figure 11:
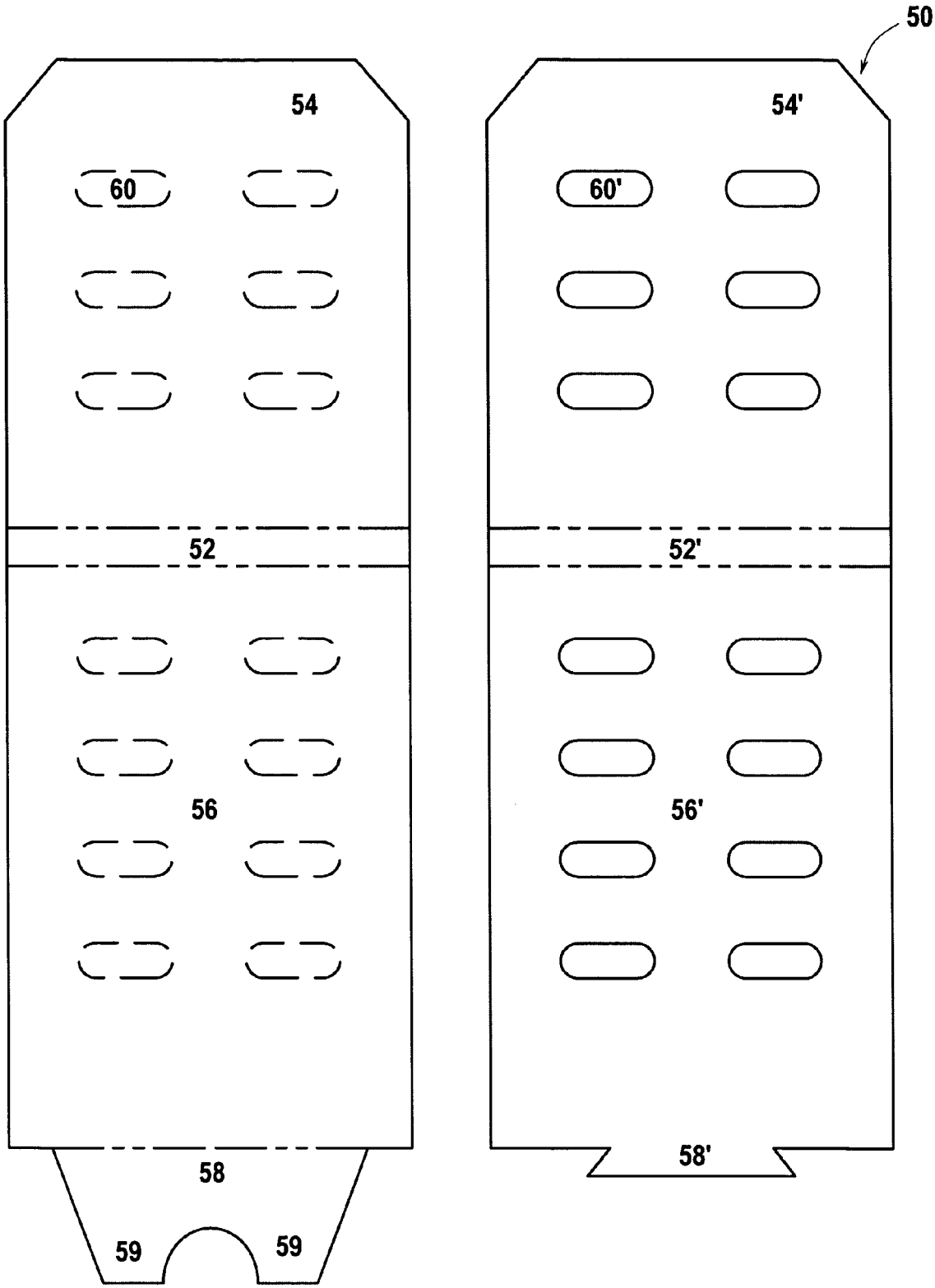
FIG. 11 is an image of a 2-card variation for the internal slide tray.

It should be noted that the internal slide tray 50 is formed from two separate cardboard layers. The internal slide tray 50 may be constructed either as a single piece unit (the top and bottom layers simply folded over) or as a two-piece unit, as illustrated in FIG. 11, where the two pieces are affixed one on top of the other. Accordingly, it can be seen that a perforated bottom portion of the single dose unit bubble pack 60' would be matched with a top portion which is a hole having the general shape of the dose unit. A plastic portion of the bubble pack 60' would then protrude through this top portion hole. FIG. 11 illustrates the bottom layer 54 and top layer 54' of the first panel of the internal slide tray, the bottom layer 52 and top layer 52' of the fold portion of the internal slide tray, and the bottom layer 56 and top layer 56' of the second panel of the internal slide tray. The end-tab 58 and sub-tab 59, discussed in more detail below, need only be present on one of the layers. An additional end tab 58' may be provided for support.

Figure 3A:
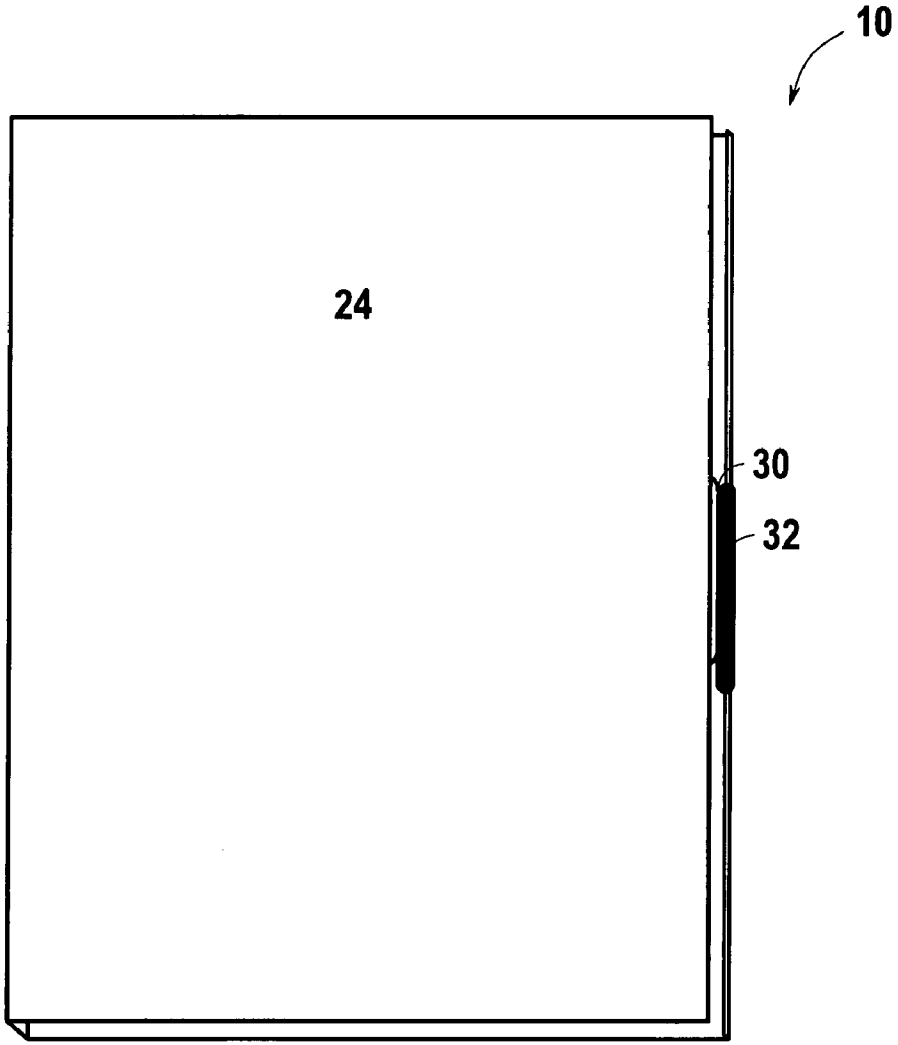
FIG. 3A is an image of an assembled outer folding carton and internal slide tray in a basically closed configuration.

In its assembled state, as illustrated by FIG. 3A, the outer folding carton 10 comprises the second primary section 110 on top. The fourth panel 24 and fifth panel 28 are glued together in portions. The fourth panel comprises a cover tab 30 that inserts into a cover tab slot 32 in its closed position.

Figure 3B:
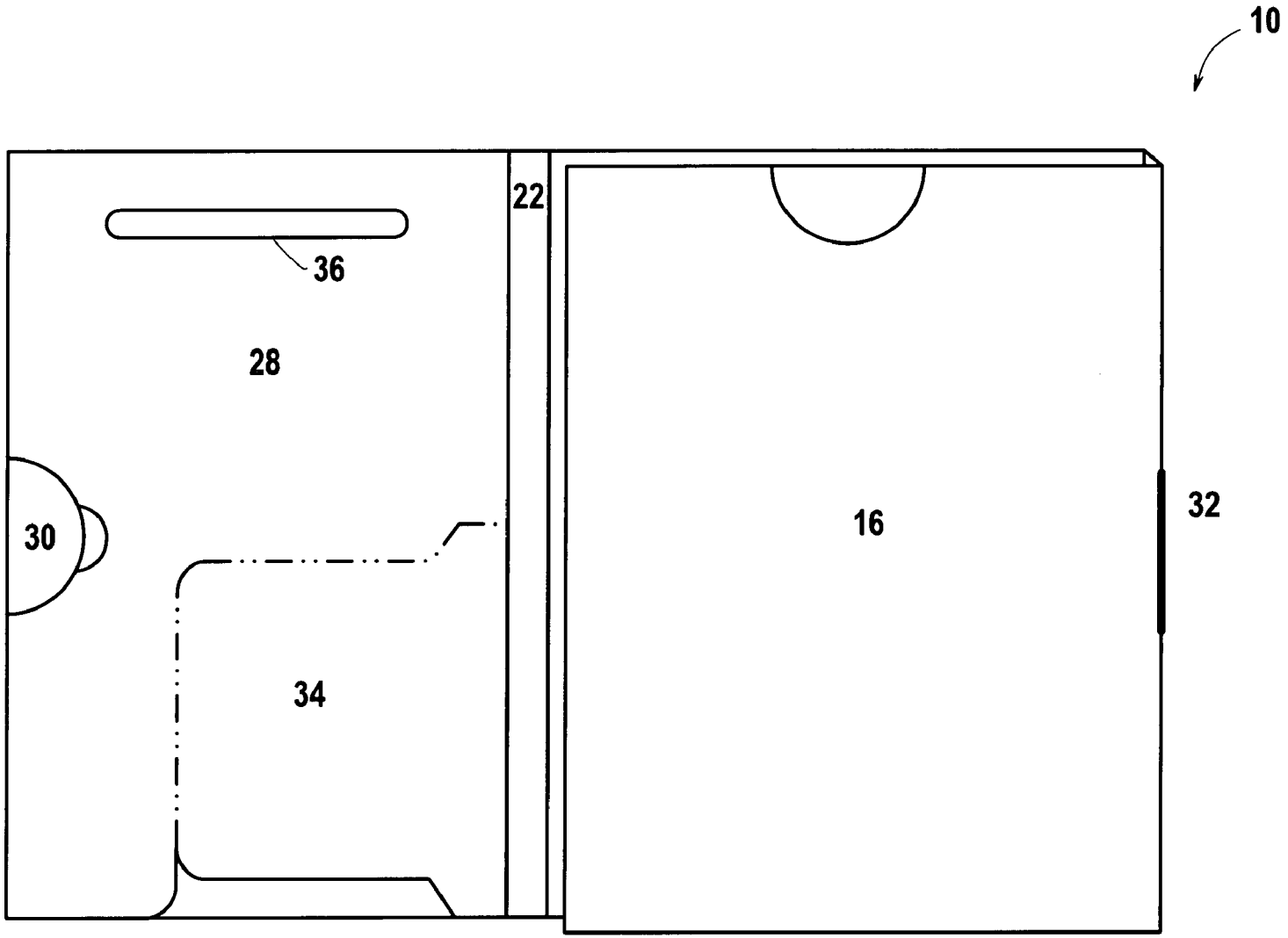
FIG. 3B is an image of an assembled outer folding carton and internal slide tray in an open and pre-use configuration.

FIG. 3B illustrates the outer folding carton 10 in an initially opened pre-use state. The cover tab 30 has not been separated from the fifth panel 28 and is still attached by a perforation. Similarly, an access card 34 remains attached to the fifth panel 28 before it has been separated and inserted into the access card storage slot 36. The user would partially separate the cover tab 30 from its perforations so that the tab 30 is hinged to the fifth panel 28 upon first use. Similarly, the user would completely separate the access card 34 and insert it into the access card storage slot 36.

Figure 4:
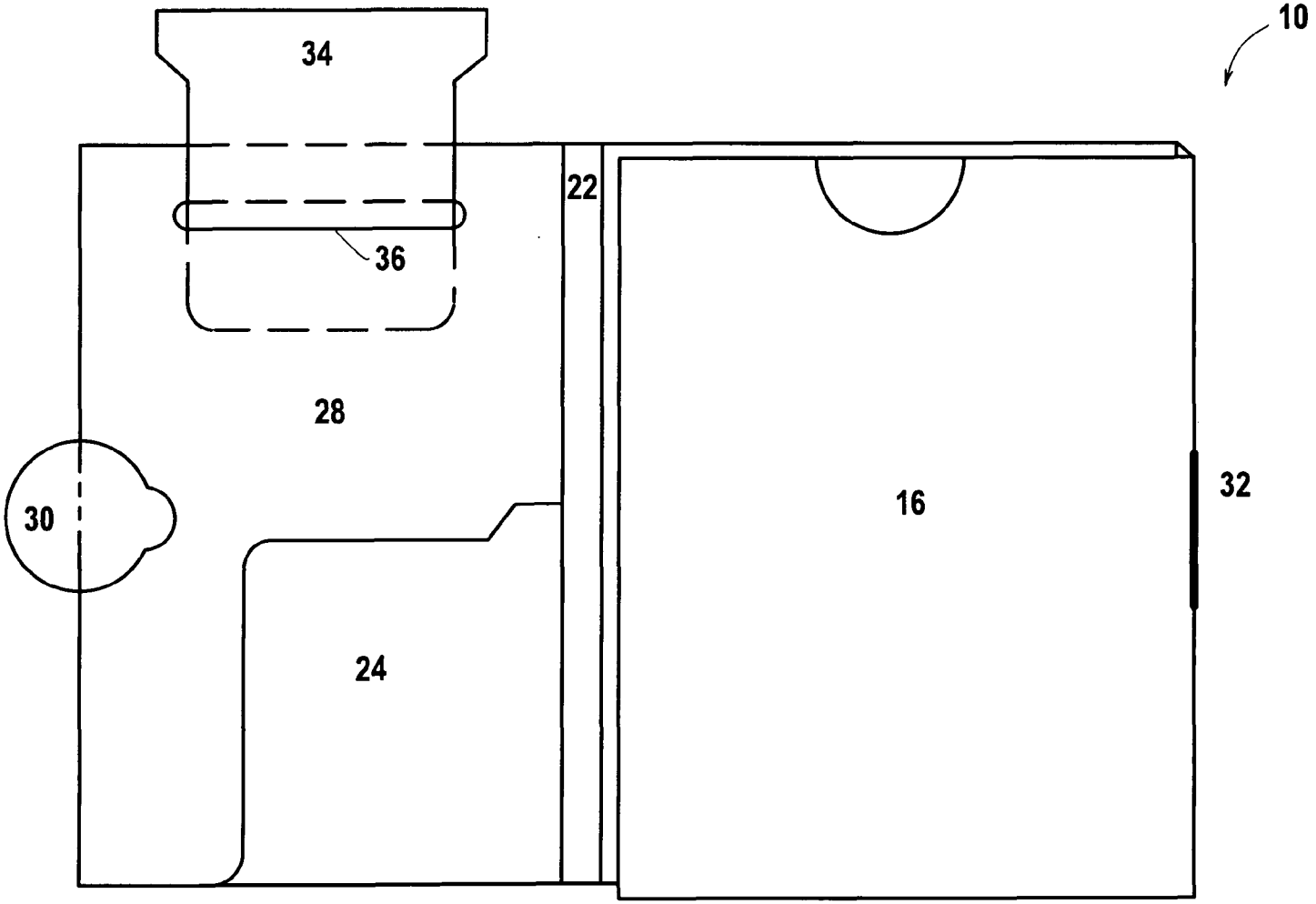
FIG. 4 is an image of the assembly in an open and ready-for-use but locked configuration

FIG. 4 illustrates the outer folding carton 10 in its initially opened, but locked, configuration after the tab 30 and access card 34 have been separated. The access card 34 is removed from its position on the fifth panel 28 (which may be originally perforated to permit its easy separation from the fifth panel 28) and inserted into a card storage slot 36 where it can be kept when the assembly is not in use. The second primary section 110 is attached to the first primary section 100 via the third fold portion 22. In this open configuration, the second panel 16 is visible on the right-hand side. It should be noted that the image FIGS. 3-10 reflect a carton that has been cut to reveal detail. The split-open portions of the first primary section 100 at the bottom and right-hand side would ordinarily be joined to the first primary section 100 in normal use. In the configuration shown in FIG. 4 (the locked configuration), the internal slide tray cannot be removed for reasons that are explained in more detail below.

It should be noted that in one embodiment, the access card 34 is the same width as a standard credit card or driver's license, so that in the event the access card 34 is lost or damaged, the user can still make use of the package using the standard credit card or drivers license. Furthermore, it is also possible that a holding mechanism may be provided so that the access card can be permanently installed to allow access for situations where, e.g., there are no children present or when the convenience of a non-child resistant design is desired. The holding mechanism can comprise glue, adhesive, cohesion, or physical elements, such as some form of interference, frictional, magnetic or other known holding mechanisms.

Figure 5:
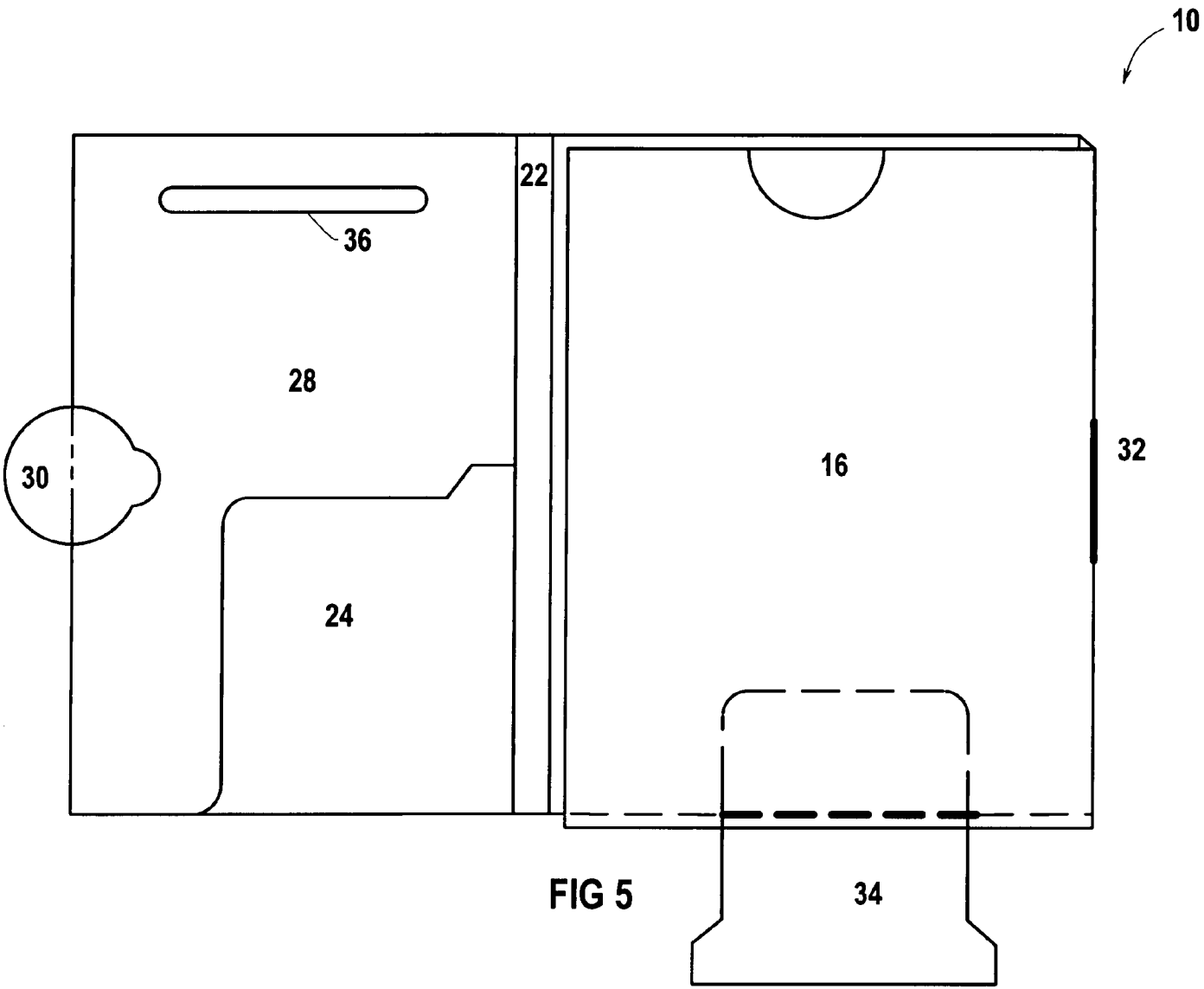
FIG. 5 is an image of the assembly showing the insertion of the access card.

FIG. 5 illustrates the insertion of the access card 34 into a card slot 42 on the third panel 42. When the access card 34 is fully inserted, the internal slide tray 50 can be extended permitting access to its contents.

Figure 6:
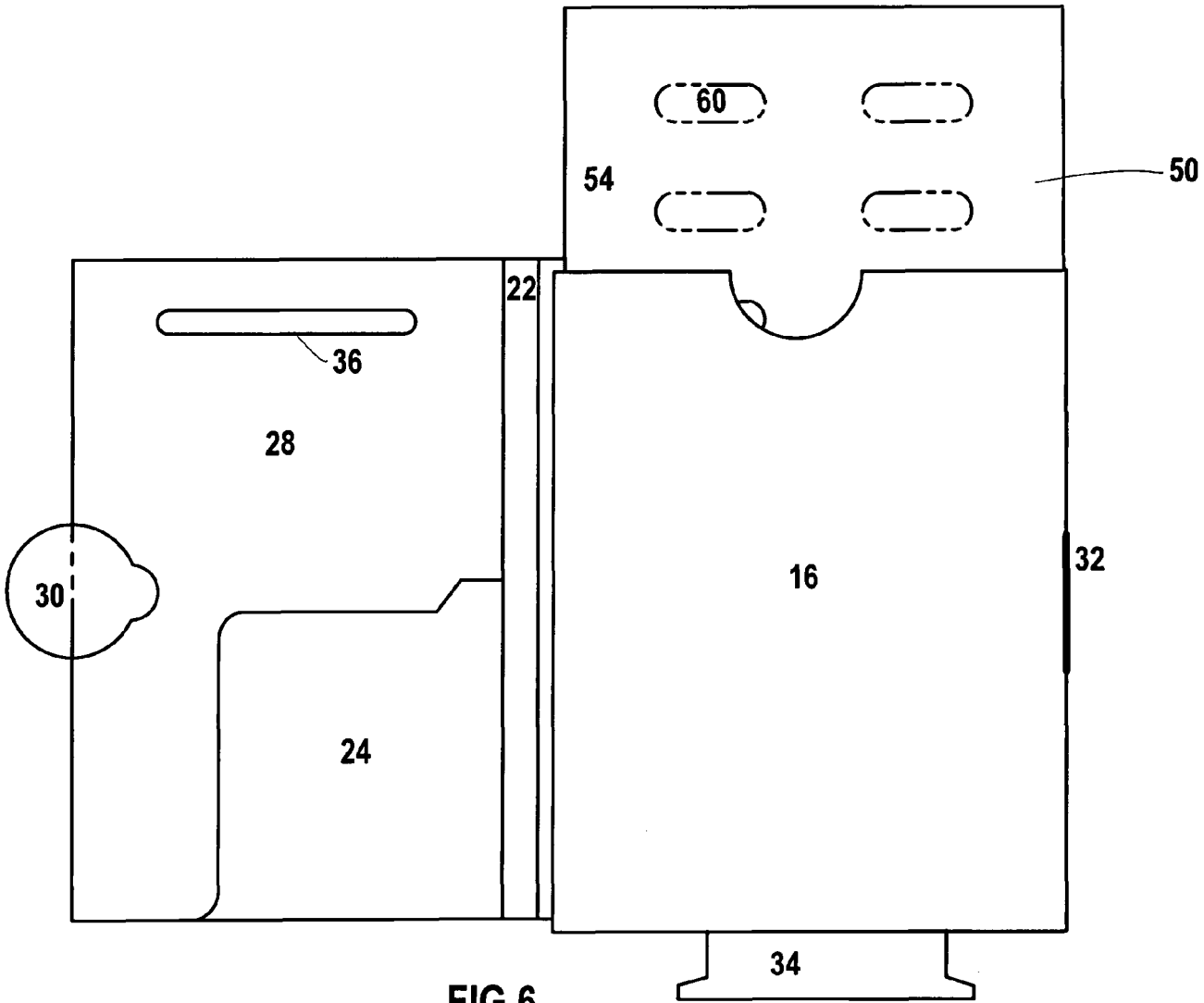
FIG. 6 is an image of the assembly showing the unlocked configuration and the internal slide tray partially extended.

FIG. 6 illustrates the unlocked configuration of the assembly. The access card 34 is fully inserted into the slot 42, and the internal slide tray 50 is partially extended. In FIG. 6, the first panel of the internal slide tray 54 is visible, as are the perforated tabs 60 on the backside of the single dose unit bubble packs 60'.

Figure 7:
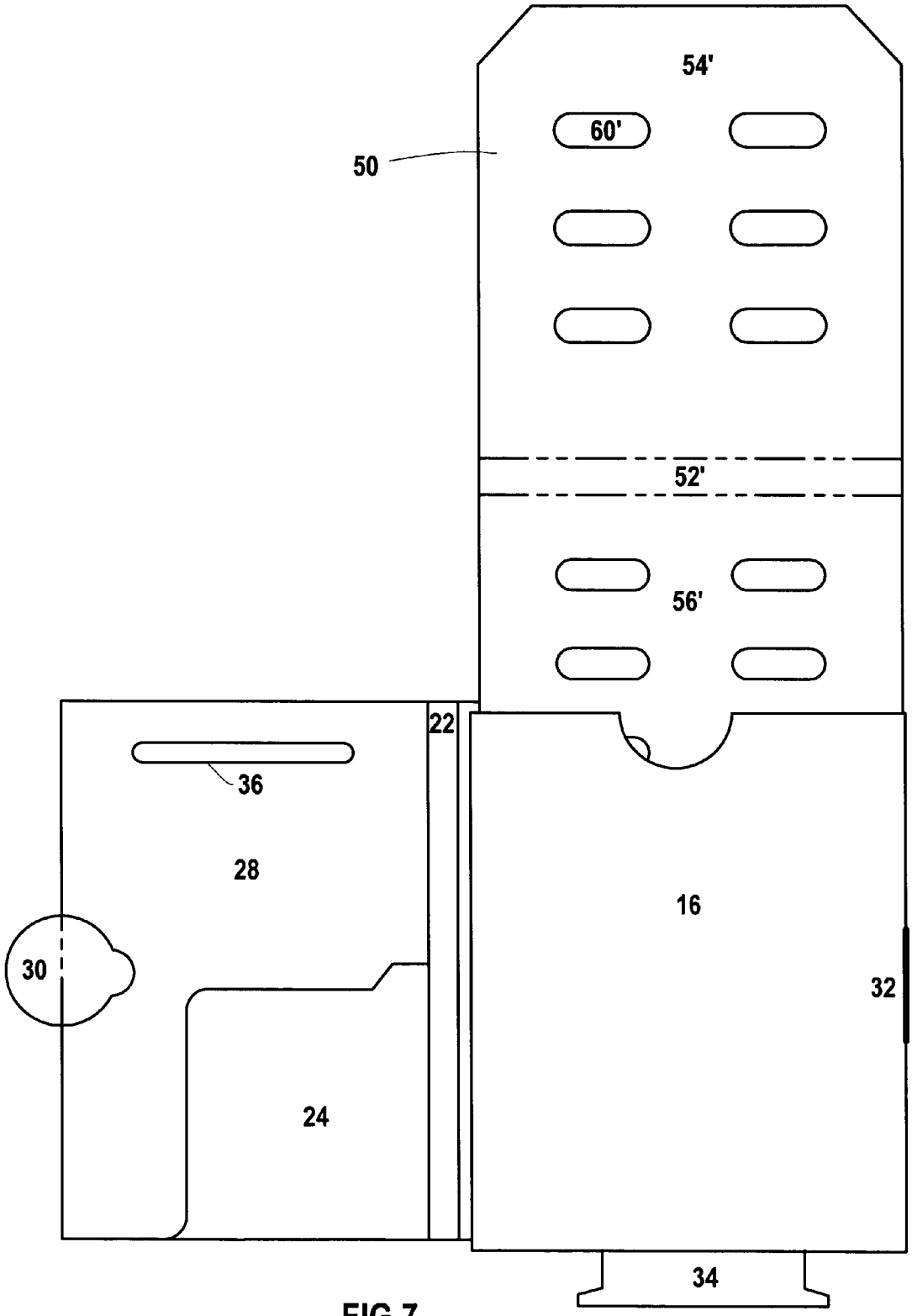
FIG. 7 is an image similar to that of FIG. 6, with the internal slide tray fully extended and opened.

As can be seen in FIG. 7, when the internal slide tray 50 is extended, it can be unfolded along fold portion 52' and the full contents on both the first 54' and second panels 56' are visible and accessible.

Figure 8:
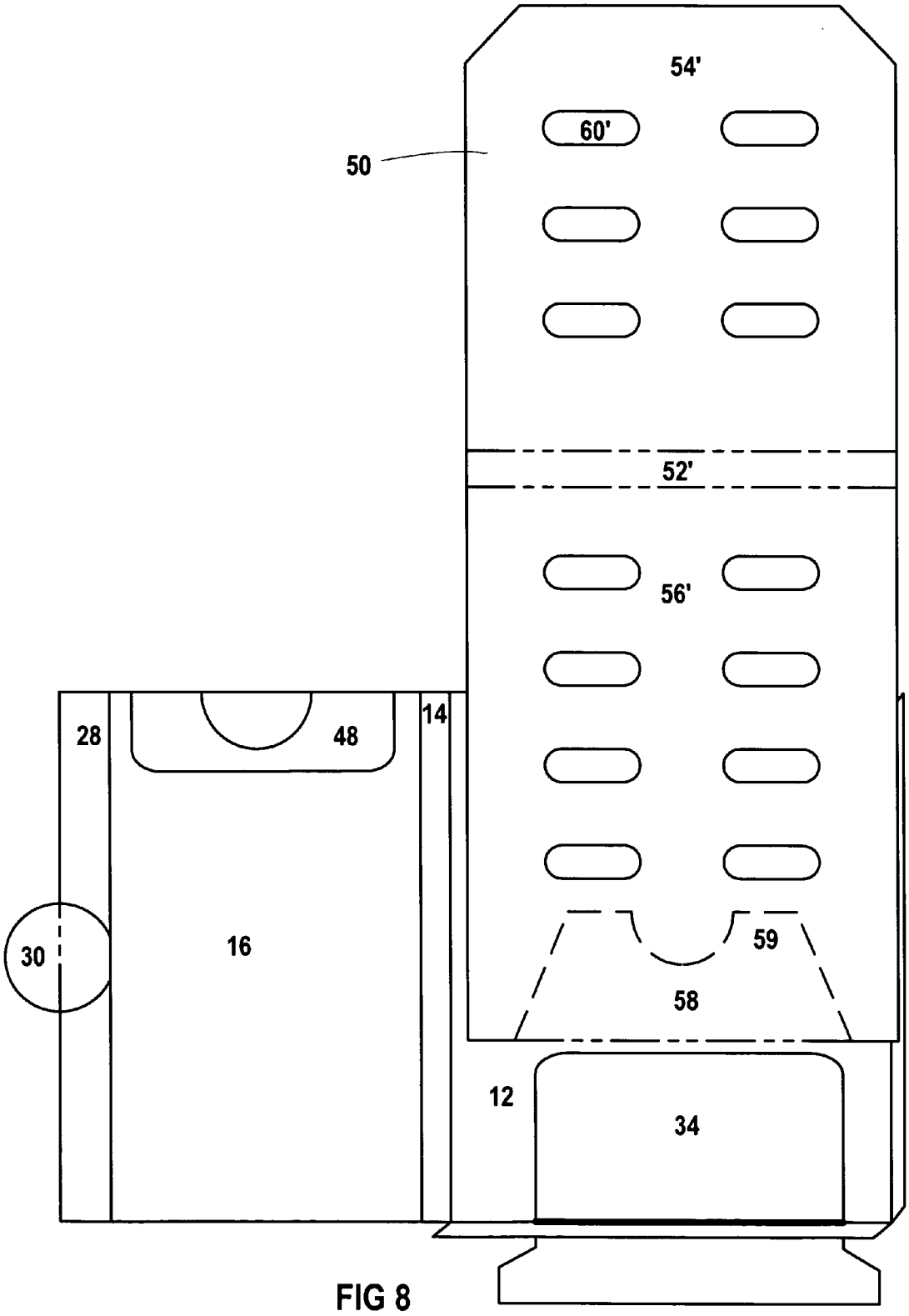
FIG. 8 is a cut-away image (not seen in normal use) showing the access card and internal slide tray extended.

FIG. 8 illustrates a cut-away view of the outer folding carton 10 that would normally not be visible during normal use, since the first panel 12 is glued to the third panel 20. To create the cut-away view, a slice has been made along the second fold portion 18 that normally connects the second panel 16 and the third panel 20. This view reveals the first fold portion 14 that connects the first panel 12 and the second panel 16. The second panel 16 comprises a flap 48 that is glued to the second panel 16 for strength and stability. In this view, the access card 34 can be seen in its inserted position.

Figure 9:
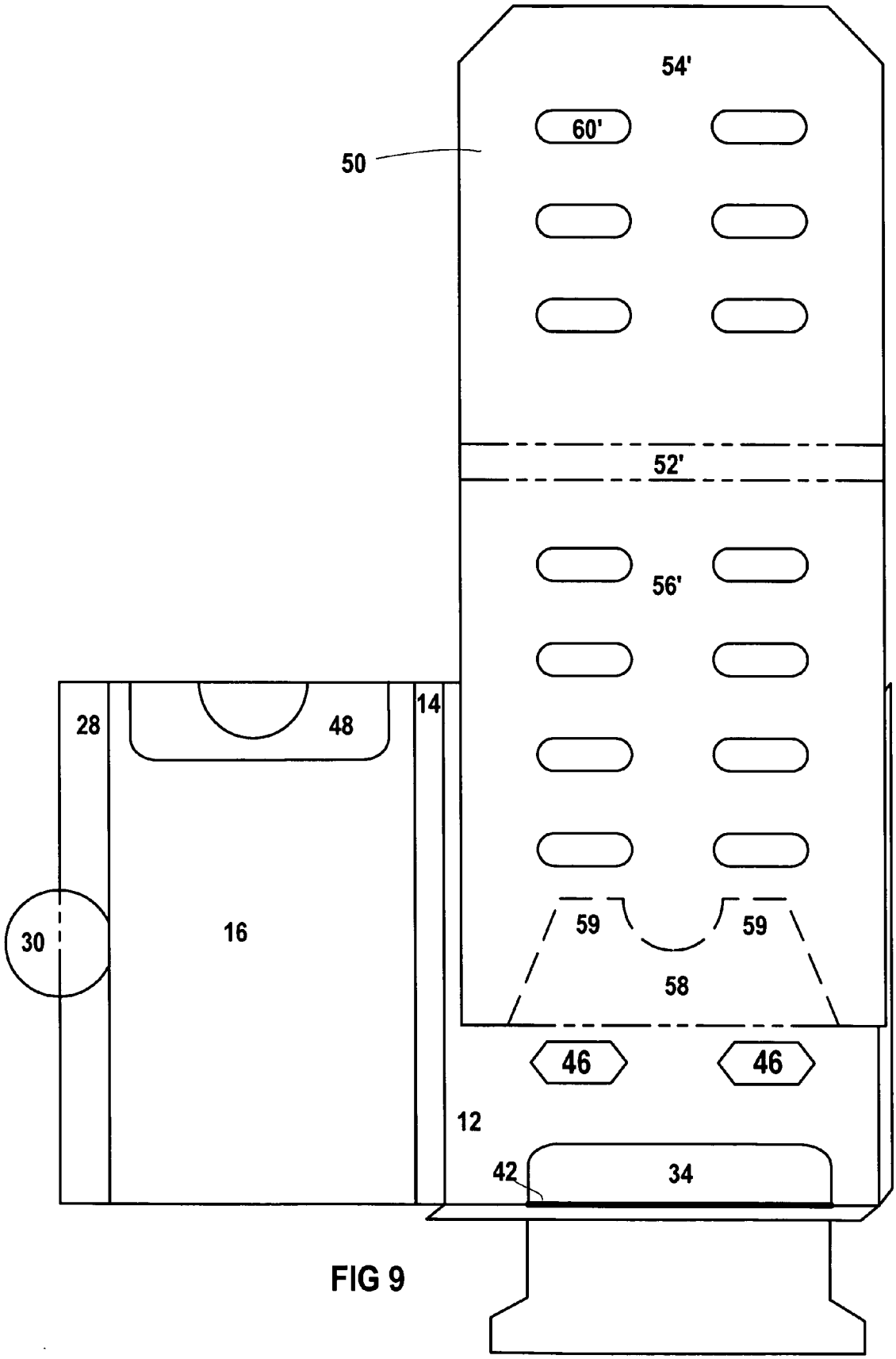
FIG. 9 is a cut-away image showing the access card partially removed to reveal the catch-holes.

FIG. 9 is similar to FIG. 8, except that the access card 34 has been withdrawn to reveal the presence of locking holes 46 present in the first panel 12. A card stop 34' can also be seen. The card stop 34' being wider than the slot 42 prevents the access card 34 from being inserted so far so that it cannot be retrieved after use.

Figure 10:
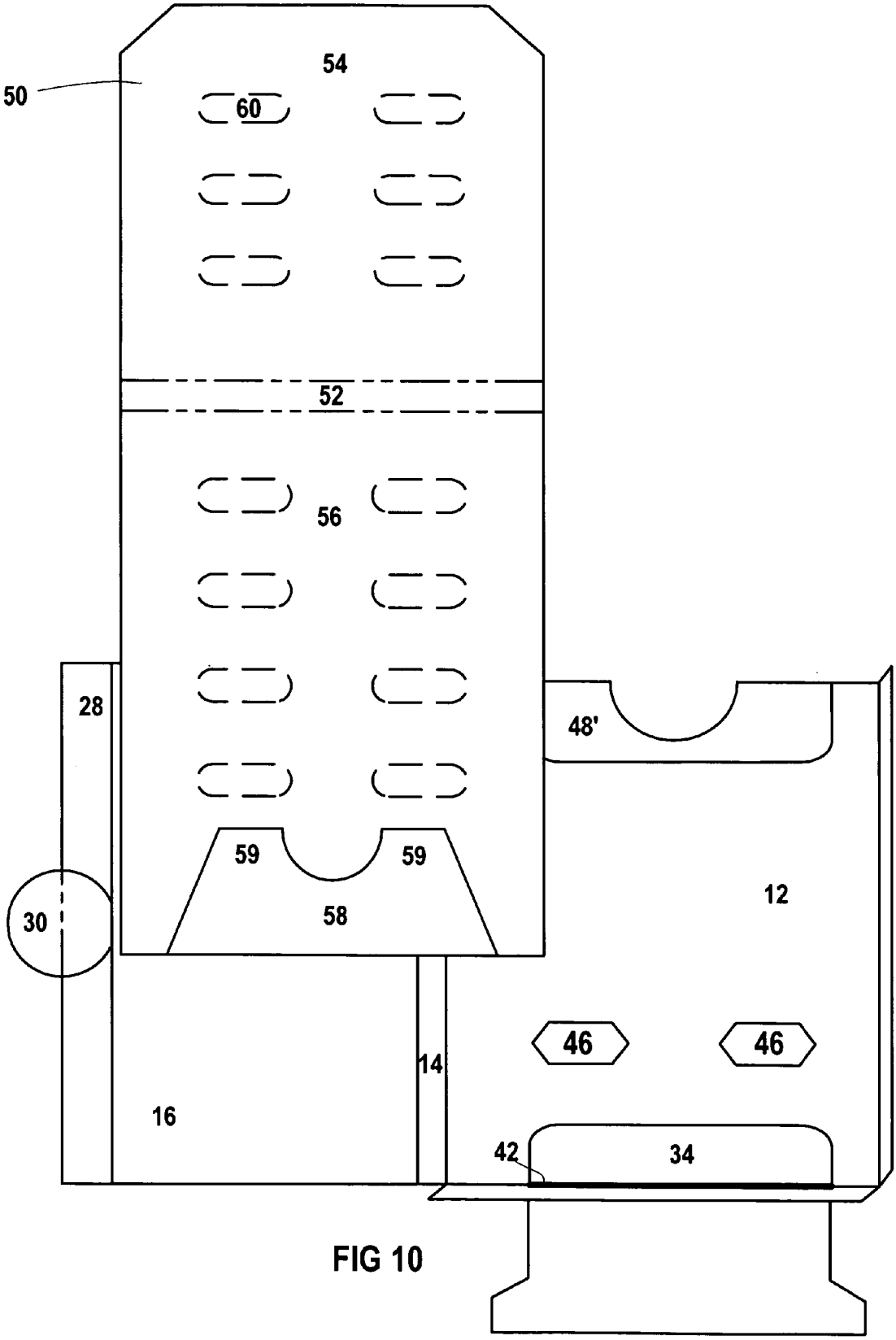
FIG. 10 is a cut-away image showing the back side of the internal slide tray.

FIG. 10 is similar to FIG. 9, except that the internal slide tray 50 has been flipped over to reveal the locking mechanism. Accordingly, without the access card 34 being inserted, the sub-tabs 59 engage the locking holes 46 due to a slight bias of the sub-tabs 59 against the surface of the first panel 12 created by the fold connecting the end tab 58 to the second panel 56 of the internal slide tray 50. Since this second panel 56 of the internal slide tray is normally pressed against the surface of the first panel 12, the sub-tabs 59 get caught in the locking holes 46 and prevent the internal slide tray 50 from being extended.

However, once the access card 34 has been inserted, it covers the locking holes 46 and prevents the sub-tabs 59 from engaging these holes. The internal slide tray 50 can then be extended until its end tab 58 engages the non-glued flap 48' of the first panel 12 and prevents removal of the internal slide tray 50. The internal slide tray 50 can then easily be re-inserted, and the card 34 removed and placed back in the card storage slot 36 for safe keeping.

Figure 12:
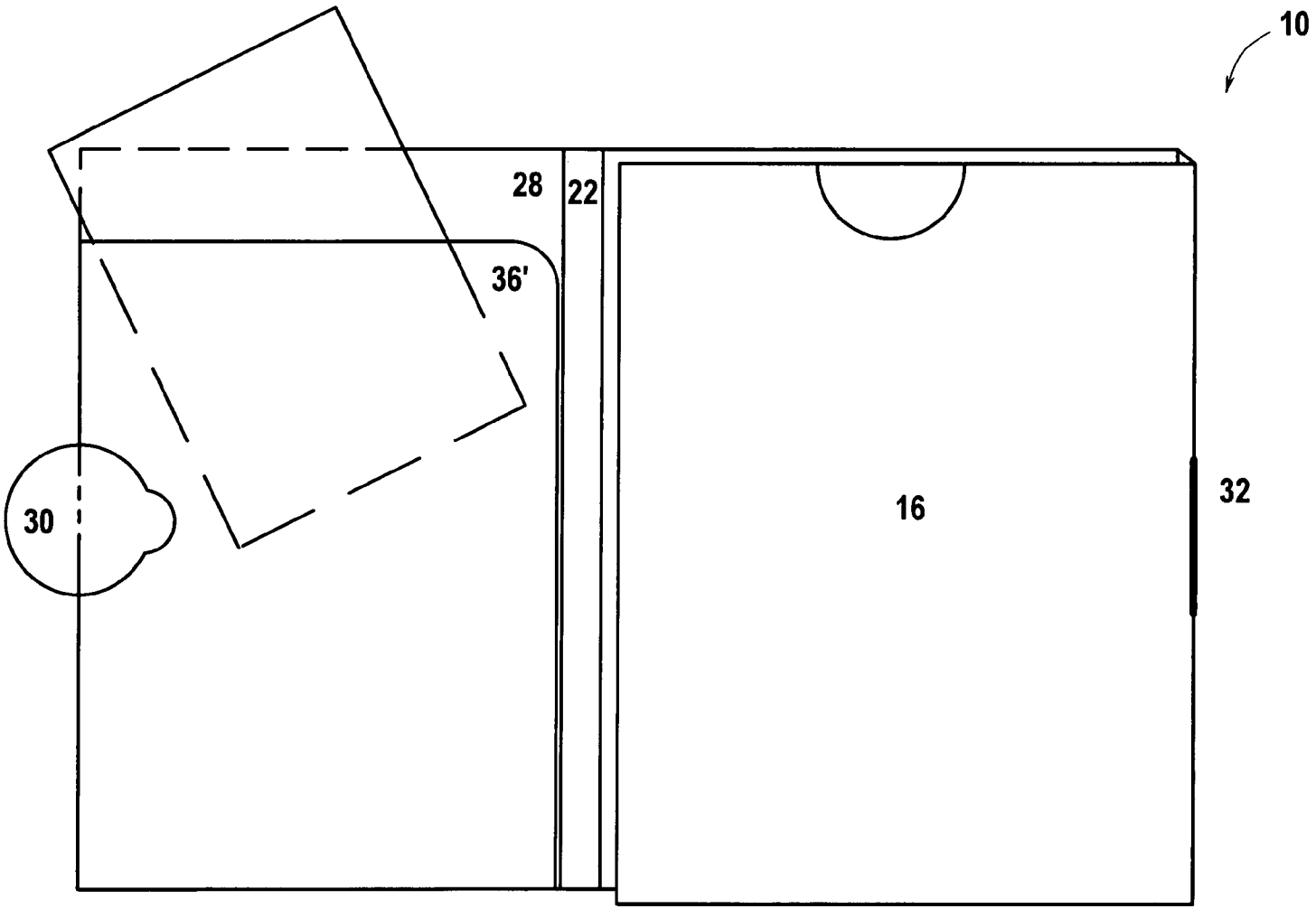
FIG. 12 is an image showing a storage area for holding leaflets, enclosures, customer instructions, regulatory information, sales or marketing information, or product literature.

FIG. 12 illustrates an embodiment utilizing a storage area 36' for holding leaflets, enclosures, customer instructions, regulatory information, sales or marketing information, or product literature.

Figure 1A:
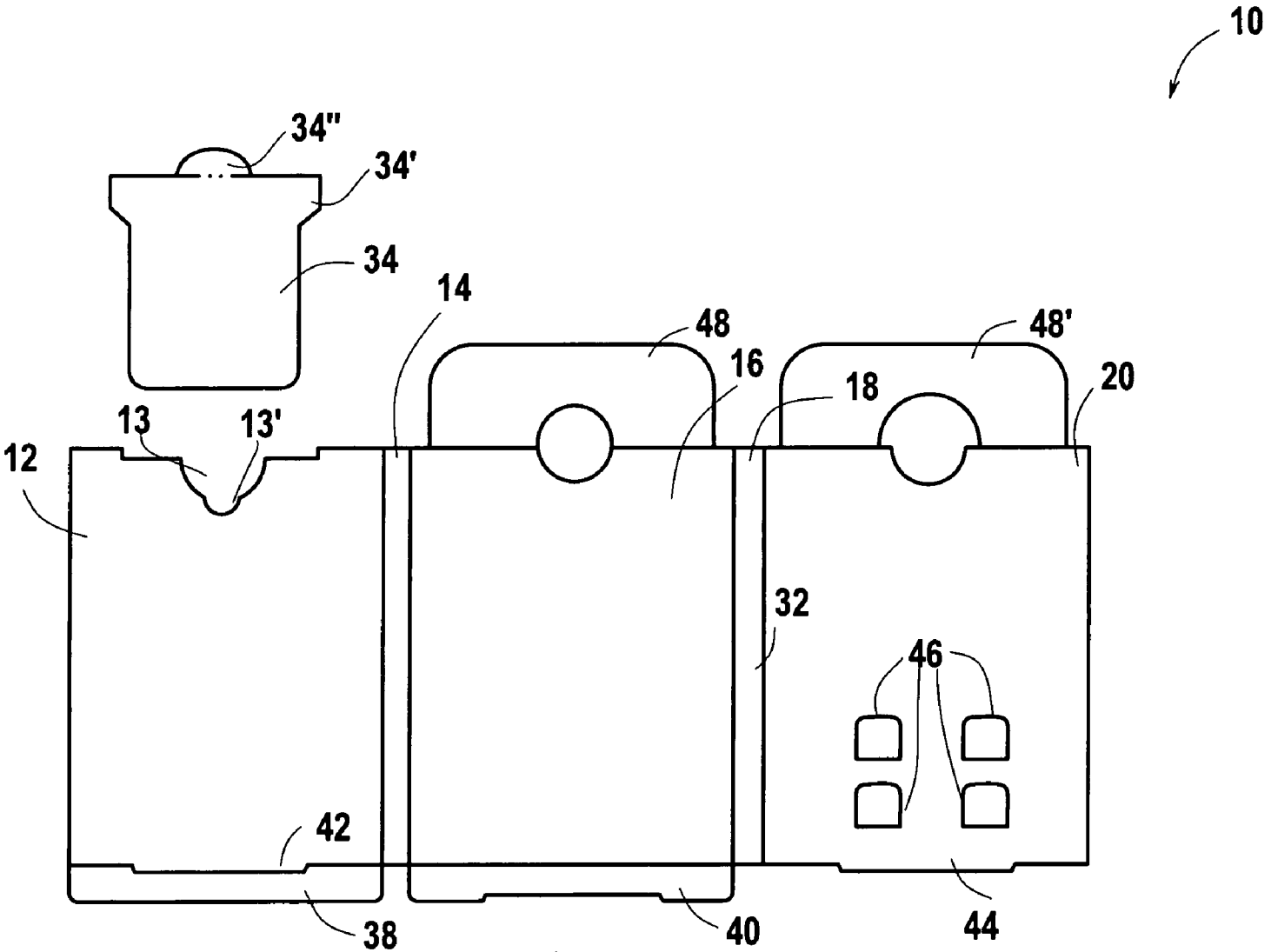
FIG. 1A is a pictorial diagram of an alternate embodiment of the unassembled outer folding carton having three panels, and with offset locking holes.

FIG. 1A illustrates an alternate simplified three-panel embodiment of the invention. The primary difference is that the access card 34 has an access card tab 34" that is initially affixed to the first panel 12 at an upper notch portion 13 of first panel 12 via perforations or other know affixing mechanism. A user access portion 13' is provided within the upper notch portion that is not filled with the tab 34" initially, which permits the user to separate the access card 34 from the first panel 12 upon first use. FIG. 1A also illustrates a pattern of four locking holes 46 in the third panel that provides an enhanced locking function. These offset holes are designed to interface with the subtabs 59 of the internal slide tray 50.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. For the sake of brevity, conventional aspects may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

TABLE OF REFERENCE CHARACTERS

10 outer folding carton
12 first panel of outer folding carton
13 upper notch portion
13' user access portion of the upper notch portion
14 first fold portion of outer folding carton
16 second panel of outer folding carton
18 second fold portion of outer folding carton
20 third panel of outer folding carton
22 third fold portion of outer folding carton
24 fourth panel of outer folding carton
26 fourth fold portion of outer folding carton
28 fifth panel of outer folding carton
30 cover tab
32 cover tab slot
34 access card
34' access card stop
34" access card tab
36 access card storage slot
36' storage area
38 lower panel extension with slot
40 lower panel extension
42 access card slot
44 panel tab
46 locking holes

48 glued flap
48' non-glued flap
50 internal slide tray
52, 52' bottom and top layers of the fold portion of internal slide tray
54, 54' bottom and top layers of the first panel of internal slide tray
56, 56' bottom and top layers of the second panel of internal slide tray
58 end tab
58' additional end tab
59 sub-tab
60 perforated tabs
60' single dose unit bubble pack
100 first primary section of outer folding carton
110 second primary section of outer folding carton

What is claimed is:

1. A product packaging system with a lock release, comprising:

an outer sleeve;

a movable insert selected from the group consisting of a movable tray, a slide card, and a package that fits within the outer sleeve comprising a product, the insert having an inaccessible position that prevents user access to the product, and an accessible position that allows user access to the product;

a locking mechanism on the outer sleeve comprising a motion inhibiting portion that engages the movable insert to maintain the inaccessible position;

an unlocking mechanism having a breaking portion that breaks the engagement of the inhibiting portion of the locking mechanism permitting the movable insert to move to the accessible position;

the locking mechanism comprises cutouts on an interior surface of said outer sleeve;

the movable insert comprises protrusions that engage the cutouts in an interference manner; and the unlocking mechanism breaking portion movable in sliding contact with the interior surface of said outer sleeve to between said cutouts and said protrusions to disengage the protrusions from the cutouts, wherein the unlocking mechanism is an access card, comprising:

a top surface;

a bottom surface; and a front edge, the front edge serving to initially contact and break the engagement and the top surface and bottom surface serving to keep the engagement broken as long as the unlocking mechanism is in contact with the locking mechanism.

2. A product packaging system with a lock release, comprising:

an outer sleeve defining an opening for receiving an unlocking mechanism;

a movable insert selected from the group consisting of a movable tray, a slide card, and a package that fits within the outer sleeve comprising a product, the insert having an inaccessible position that prevents user access to the product, and an accessible position that allows user access to the product;

a locking mechanism on the outer sleeve comprising a motion inhibiting portion that engages the movable insert when the movable insert is in a lockable position to maintain said movable insert in the inaccessible position; and a physically detachable or detached unlocking mechanism having a breaking portion that breaks the engagement of the inhibiting portion of the locking mechanism permitting the movable insert to move to the accessible position when the breaking portion is inserted though the opening in the outer sleeve, the breaking portion being configured to selectively remain in a force-free position inserted through the opening to maintain an unlocked condition of the locking mechanism while the movable insert remains in the lockable position in the outer sleeve, the breaking portion being selectively removable from the opening so that the locking mechanism regains a locked condition, the physically detachable or detached unlocking mechanism being completely detachable from the outer sleeve and the movable insert, wherein the unlocking mechanism is initially physically bound to the system prior to being physically detached upon first use.

3. A product packaging system with a lock release, comprising:

an outer sleeve;

a movable insert selected from the group consisting of a movable tray, a slide card, and a package that fits within the outer sleeve comprising a product, the insert having an inaccessible position that prevents user access to the product, and an accessible position that allows user access to the product;

a locking mechanism on the outer sleeve comprising a motion inhibiting portion that engages the movable insert to maintain the inaccessible position; and a physically detachable or detached unlocking mechanism having a breaking portion that breaks the engagement of the inhibiting portion of the locking mechanism permitting the movable insert to move to the accessible position, said unlocking mechanism including an access card that is initially bound to the system by a perforation cut that is broken to fully detach the access card from the system upon first use prior.

4. A product packaging system with a lock release, comprising:

an outer sleeve defining an opening for receiving an unlocking mechanism;

a movable insert selected from the group consisting of a movable tray, a slide card, and a package that fits within the outer sleeve comprising a product, the insert having an inaccessible position that prevents user access to the product, and an accessible position that allows user access to the product;

a locking mechanism on the outer sleeve comprising a motion inhibiting portion that engages the movable insert when the movable insert is in a lockable position to maintain said movable insert in the inaccessible position; and a physically detachable or detached unlocking mechanism having a breaking portion that breaks the engagement of the inhibiting portion of the locking mechanism permitting the movable insert to move to the accessible position when the breaking portion is inserted though the opening in the outer sleeve, the breaking portion being configured to selectively remain in a force-free position inserted through the opening to maintain an unlocked condition of the locking mechanism while the movable insert remains in the lockable position in the outer sleeve, the breaking portion being selectively removable from the opening so that the locking mechanism regains a locked condition, the physically detachable or detached unlocking mechanism being completely detachable from the outer sleeve and the movable insert;

wherein the product comprises multiple dose units.

5. A product packaging system with a lock release, comprising:

an outer sleeve defining an opening for receiving an unlocking mechanism;

a movable insert selected from the group consisting of a movable tray, a slide card, and a package that fits within the outer sleeve comprising a product, the insert having an inaccessible position that prevents user access to the product, and an accessible position that allows user access to the product;

a locking mechanism on the outer sleeve comprising a motion inhibiting portion that engages the movable insert when the movable insert is in a lockable position to maintain said movable insert in the inaccessible position; and a physically detachable or detached unlocking mechanism having a breaking portion that breaks the engagement of the inhibiting portion of the locking mechanism permitting the movable insert to move to the accessible position when the breaking portion is inserted though the opening in the outer sleeve, the breaking portion being configured to selectively remain in a force-free position inserted through the opening to maintain an unlocked condition of the locking mechanism while the movable insert remains in the lockable position in the outer sleeve, the breaking portion being selectively removable from the opening so that the locking mechanism regains a locked condition, the physically detachable or detached unlocking mechanism being completely detachable from the outer sleeve and the movable insert;

wherein the system is formed out of paperboard or synthetic paperboard materials.

6. A product packaging system with a lock release, comprising:

an outer sleeve defining an opening for receiving an unlocking mechanism;

a movable insert selected from the group consisting of a movable tray, a slide card, and a package that fits within the outer sleeve comprising a product, the insert having inaccessible position that prevents user access to the product, and an accessible position that allows user access to the product;

a locking mechanism on the outer sleeve comprising a motion inhibiting portion that engages the movable insert when the movable insert is in a lockable position to maintain said movable insert in the inaccessible position; and a physically detachable or detached unlocking mechanism having a breaking portion that breaks the engagement of the inhibiting portion of the locking mechanism permitting the movable insert to move to the accessible position when the breaking portion is inserted though the opening in the outer sleeve, the breaking portion being configured to selectively remain in a force-free position inserted through the opening to maintain an unlocked condition of the locking mechanism while the movable insert remains in the lockable position in the outer sleeve, the breaking portion being selectively removable from the opening so that the locking mechanism regains a locked condition, the physically detachable or detached unlocking mechanism being completely detachable from the outer sleeve and the movable insert;

wherein the system, other than the product or immediate product holder is formed exclusively out of paperboard or synthetic paperboard materials.

7. A product packaging system with a lock release, comprising:

an outer sleeve;

a movable insert selected from the group consisting of a movable tray, a slide card, and a package that fits within the outer sleeve comprising a product, the insert having an inaccessible position that prevents user access to the product, and an accessible position that allows user access to the product;

a locking mechanism on the outer sleeve comprising a motion inhibiting portion that engages the movable insert to maintain the inaccessible position; and a physically detachable or detached unlocking mechanism having a breaking portion that breaks the engagement of the inhibiting portion of the locking mechanism permitting the movable insert to move to the accessible position, said unlocking mechanism being an end-user-supplied unlocking mechanism, said end-user-supplied unlocking mechanism being selected from the group consisting of a drivers license, business card, credit/debit card, insurance card, or association card, the unlocking mechanism remaining in a position breaking the engagement of the inhibiting portion with the movable insert without continued application of force while said movable insert is in a fully inserted and lockable position.

8. A product packaging system with a lock release, comprising:

an outer sleeve;

a movable insert selected from the group consisting of a movable tray, a slide card, and a package that fits within the outer sleeve comprising a product, the insert having an inaccessible position that prevents user access to the product, and an accessible position that allows user access to the product;

a locking mechanism on the outer sleeve comprising a motion inhibiting portion that engages the movable insert to maintain the inaccessible position by inhibiting motion of the movable insert from a fully inserted position;

a physically detachable or detached unlocking mechanism having a breaking portion that breaks the engagement of the inhibiting portion of the locking mechanism permitting the movable insert to move to the accessible position; and a holding mechanism for holding the unlocking mechanism in place to maintain the locking mechanism in an unlocked condition without continued application of force while the movable insert is in the fully inserted position so as to permit the movable insert to move into its accessible position to permit the system to permanently remain in its accessible configuration, wherein the holding mechanism is selected from the group consisting of adhesive, glue and cohesion.

9. A product packaging system with a lock release, comprising:

an outer sleeve defining an opening for receiving an unlocking mechanism;

a movable insert selected from the group consisting of a movable tray, a slide card, and a package that fits within the outer sleeve comprising a product, the insert having an inaccessible position that prevents user access to the product, and an accessible position that allows user access to the product;

a locking mechanism on the outer sleeve comprising a motion inhibiting portion that engages the movable insert when the movable insert is in a lockable position to maintain said movable insert in the inaccessible position;

a physically detachable or detached unlocking mechanism having a breaking portion that breaks the engagement of the inhibiting portion of the locking mechanism permitting the movable insert to move to the accessible position when the breaking portion is inserted though the opening in the outer sleeve, the breaking portion being configured to selectively remain in a force-free position inserted through the opening to maintain an unlocked condition of the locking mechanism while the movable insert remains in the lockable position in the outer sleeve, the breaking portion being selectively removable from the opening so that the locking mechanism regains a locked condition, the physically detachable or detached unlocking mechanism being completely detachable from the outer sleeve and the movable insert;

a slide removal preventing member engaging the movable insert to prevent full removal of the movable insert from the outer sleeve.

* * * * *